United States Patent [19]

Blumkin et al.

[11] Patent Number: 4,854,132

[45] Date of Patent: Aug. 8, 1989

[54] EARRING FOR THE 2 HOLE EAR

[76] Inventors: Irene S. Blumkin, 5 Meyer Dr., Putnam Valley, N.Y. 10579; George Spector, 233 Broadway, Rm. 3615, New York, N.Y. 10007

[21] Appl. No.: 839,627

[22] Filed: Mar. 14, 1986

[51] Int. Cl.[4] ..... A44C 7/00

[52] U.S. Cl. ..... 63/12; 63/13

[58] Field of Search ..... 63/5 R, 5 A, 6, 10, 63/12, 13, 14 R, 14 A, 14 B, 14 C, 14 D, 14 E, 14 F, 14 G; 24/41, 90 A

[56] References Cited

U.S. PATENT DOCUMENTS

| | | | |
|---|---|---|---|
| 2,433,711 | 12/1947 | Schober et al. | 63/14 E |
| 2,956,422 | 10/1960 | Davidson | 63/13 |
| 3,071,939 | 1/1963 | Feibelman | 63/14 R |
| 3,260,068 | 7/1966 | Micallef | 63/12 |
| 3,465,542 | 9/1969 | Pintarelli | 63/14 C |
| 3,813,732 | 6/1974 | Seavey | 24/41 |
| 4,218,894 | 8/1980 | Tropea | 63/13 |
| 4,242,776 | 1/1981 | Kurashima | 24/41 |
| 4,249,393 | 2/1981 | Ciambra | 63/12 |
| 4,471,510 | 9/1984 | DeRosa | 24/90 A |
| 4,489,572 | 12/1984 | Wilczewski | 63/13 |
| 4,566,155 | 1/1986 | Kurashima | 24/90 A |

*Primary Examiner*—Robert A. Hafer
*Assistant Examiner*—Michael Brown

[57] ABSTRACT

Earrings for an earlobe having two pierced holes is provided and consists of two earring elements. Each of the earring elements includes an ornament and a mechanism for mounting the ornament to the earlobe so that the earring elements are in esthetic relationship to each other.

3 Claims, 1 Drawing Sheet

Fig. 3
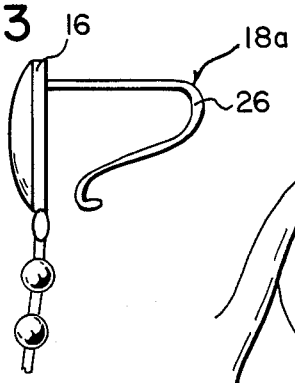
Fig. 1
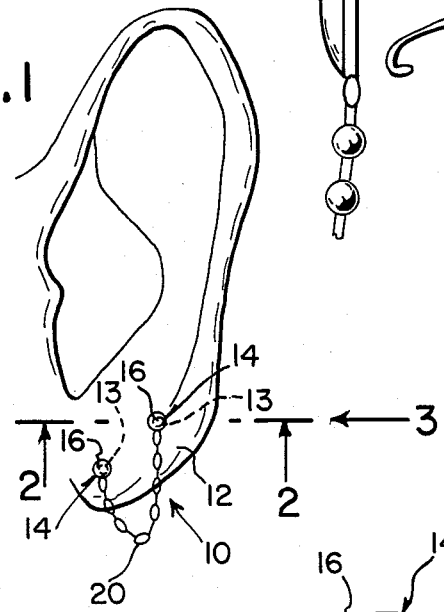
Fig. 4
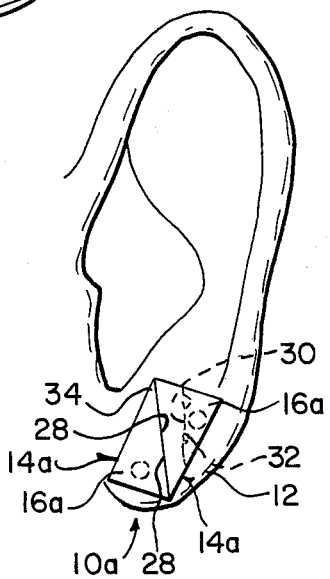
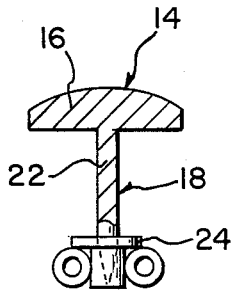
Fig. 2
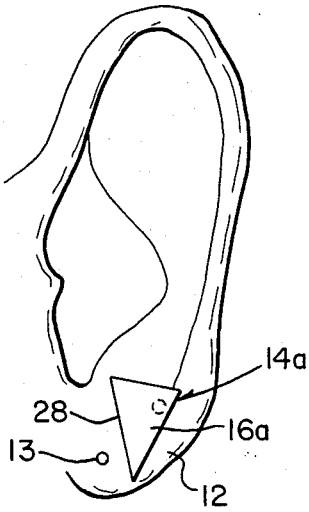
Fig. 5
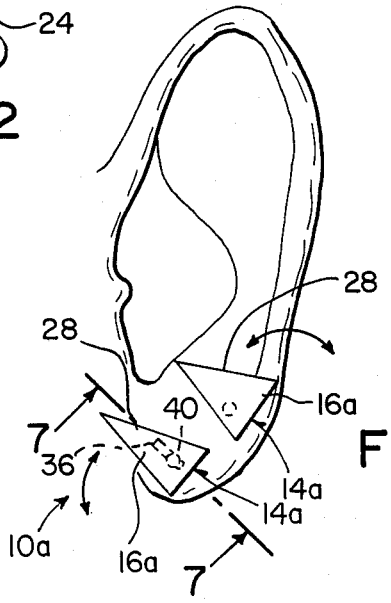
Fig. 6
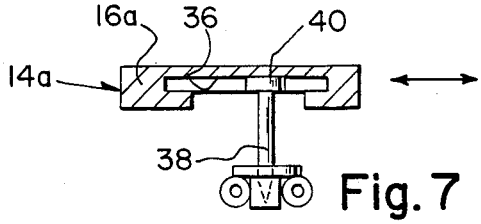
Fig. 7

EARRING FOR THE 2 HOLE EAR

BACKGROUND OF THE INVENTION

The instant invention relates generally to jewelry ornaments and more specifically it relates to earrings for an earlobe having two pierced holes.

Numerous jewelry ornaments have been provided in prior art that are adapted to be worn by a female person. For example U.S. Pat. Nos. 1,115,280; 2,869,338 and 4,489,572 all are illustrative of such prior art. While these units may be suitable for the particular purpose to which they address, they would not be as suitable for the purposes of the present invention as heretofore described.

SUMMARY OF THE INVENTION

A principle object of the present invention is to provide earrings for an earlobe having two pierced holes that will overcome the shortcomings of the prior art devices.

Another object is to provide earrings for an earlobe having two pierced holes wherein the two earring elements which are worn on the earlobe have an esthetic relationship to each other.

An additional object is to provide earrings for an earlobe having two pierced holes wherein the two earring elements are separate and adjustable on the earlobe so that a person can create various combinations of designs with the two earring elements.

A further object is to provide earrings for an earlobe having two pierced holes that is simple and easy to use.

A still further object is to provide earrings for an earlobe having two pierced holes that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front view of the invention worn on an earlobe having two pierced holes.

FIG. 2 is an enlarged cross/sectional view taken along line 2—2 in FIG. 1 showing one of the earring elements being of a post type with a friction nut thereon.

FIG. 3 is an enlarged side view taken in the direction of the arrow 3 in FIG. 1 showing one of the earring elements being of a wire type.

FIG. 4 is a front view of a modification showing two earring elements worn on the earlobe being used as one complete unit.

FIG. 5 is a front view similar to FIG. 4 showing one earring element worn on the earlobe being used as a separate unit.

FIG. 6 is a front view similar to FIG. 5 showing the two earring elements turned so as to be used as two separate units.

FIG. 7 is an enlarged cross sectional view taken along line 7—7 in FIG. 6 showing an adjustment slot within the ornament of one of the earring elements so that the ornament can be shifted with respect to the post.

DETAILED DESCRIPTION OF THE PREFERRED EMBODIMENTS

Turning now descriptively to the drawings, in which similar reference characters denote similar elements throughout the several views, FIGS. 1 and 2 illustrate earrings 10 for an earlobe 12 having two pierced holes 13 consisting of two earring elements 14. Each of the earring elements 14 includes an ornament 16 and mechanism 18 for mounting the ornament 16 to the earlobe 12. A chain of beads 20 is secured on each end to one of the ornaments 16 so that the earring elements 14 are indirectly connected to each other.

The mounting mechanism 18 includes a friction post 22 affixed at one end to the ornament 16 and can center one of the pierced holes 13. A friction nut 24 is removably attached to free end of the post 22 to secure the ornament 16 to the earlobe 12.

In FIG. 3 another type of mounting mechanism **18*a* is shown and includes a curved earwire 26 affixed at one end to the ornament 16 and can enter one of the pierced holes 13 to secure the ornament 16 to the earlobe 12**.

In a modified form the earring elements **14*a* of earrings 10*a* contain ornaments 16*a* each of which is formed as a right angle triangle that has a hypotenuse 28. The hypotenuses 28 can adjoin each other in one position as shown in FIG. 4. In another position, as shown in FIG. 6, the ornaments 16*a* can be turned so that the hypothenuses 28 are separated. FIG. 5 shows just one earring element 14*a* worn by itself like a regular earring. It could be turned so that the pierced hole 13 can be covered by the ornament 16*a***.

In FIG. 4 one of the right angle triangle ornaments **16*a* has an internal recess 30 extending inwardly from the hypotenuse 28 as indicated by the dotted line extending from reference numeral 30. The recess 30 has a plurality of stop indents 32 therein allowing contact to be made with tip 34 of the other of the right angle ornaments 16*a*** at various locations. The ornaments can now be turned relative to and into each other to form varying combined shapes.

In FIGS. 6 and 7 one of the right angle triangle ornaments **16*a* has an adjustment slot 36 on the underside thereof. A friction post 38 is provided that has a head 40 at one end that forceably slides within the adjustment slot 36 so that the ornament 16*a* can be shifted with respect to the post 38**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Earrings for an earlobe having spaced pierced holes wherein each of said earrings includes an ornament on a post in combination with means for adjusting each said ornament relative to each other to provide varying aesthetic relationships, said means including said ornaments having adjoining sides with means for nesting with each other at varying relative positions thus providing an assembled ornament of variable shape further including said ornaments having means for slidably mounting said post to said ornament so that said ornaments are transversely adjustable relative to said posts to provide relative transverse movement of each ornament relative to each post.

2. Earrings as recited in claim 1, wherein one said sides of said ornaments includes an internal recess extending inwardly adapted to receive the other of said sides, including a plurality of stop indents adjacent the recess coacting with part of said other side so that said ornaments can be moved to nesting positions to present varying combined ornamental shapes.

3. Earrings as recited in claim 2 wherein each of said ornaments have an adjustment slot on underside thereof and a friction post having a head at one end that forceably slides within said adjustment slot so that said ornament can be shifted with respect to each said post to vary the relative position of each ornament relative to each post.

* * * * *